US009546082B2

(12) United States Patent
Balcom

(10) Patent No.: US 9,546,082 B2
(45) **Date of Patent: *Jan. 17, 2017**

(54) FORK TRUCK BOOM APPARATUS

(71) Applicant: David E. Balcom, Wyoming, MI (US)

(72) Inventor: David E. Balcom, Wyoming, MI (US)

( * ) Notice: Subject to any disclaimer, the term of this patent is extended or adjusted under 35 U.S.C. 154(b) by 353 days.

This patent is subject to a terminal disclaimer.

(21) Appl. No.: 14/173,472

(22) Filed: Feb. 5, 2014

(65) Prior Publication Data

US 2014/0262627 A1 Sep. 18, 2014

Related U.S. Application Data

(60) Provisional application No. 61/778,734, filed on Mar. 13, 2013.

(51) Int. Cl.
*B66F 9/12* (2006.01)
*B66F 9/18* (2006.01)

(52) U.S. Cl.
CPC ..... *B66F 9/18* (2013.01)

(58) Field of Classification Search
CPC ..... B66F 9/18; B66F 9/122
See application file for complete search history.

(56) References Cited

U.S. PATENT DOCUMENTS

| | | | | |
|---|---|---|---|---|
| 68,217 | A | 8/1867 | Lewis | |
| 95,573 | A | 10/1869 | Dodge | |
| 1,460,082 | A | 6/1923 | Spahr | |
| 2,386,759 | A | 10/1945 | Ulm | |
| 2,468,326 | A * | 4/1949 | Gleason | B66F 9/125 414/592 |
| 2,832,489 | A | 4/1958 | Bailey | |
| 2,941,683 | A | 6/1960 | Fowler | |
| 2,944,689 | A | 7/1960 | Arnot | |
| 2,990,074 | A | 6/1961 | Berquist et al. | |
| 3,007,592 | A | 11/1961 | Adams | |

(Continued)

FOREIGN PATENT DOCUMENTS

| | | |
|---|---|---|
| JP | 54039873 | 3/1979 |
| JP | 02175598 | 7/1990 |
| KR | 1020090076041 | 7/2009 |

OTHER PUBLICATIONS

International Search Report and Written Opinion of the International Searching Authority dated Oct. 27, 2011 (International Application No. PCT/US2011/028462).

*Primary Examiner* — William E Dondero
*Assistant Examiner* — Diem Tran
(74) *Attorney, Agent, or Firm* — Price Heneveld LLP

(57) ABSTRACT

A boom accessory for a fork truck comprises a frame having a back stiffener, a convertiplate attached to the back stiffener, receiver tubes for receiving forks of a fork truck, a boom extending forwardly from the frame, and an anchor assembly on the frame. Top and bottom connectors are configured to securely engage cross bars on the fork truck's carriage. The anchor restrains the boom frame from horizontally sliding off the forks when the forks are used for lifting. The anchor can be left on when the top and bottom connectors are used for lifting the boom accessory, or can be removed. The anchor attaches to either the back stiffener or the convertiplate, or can be taken off and stored on the boom apparatus, thus providing different attachment mechanisms for attaching the boom accessory to a fork truck.

14 Claims, 8 Drawing Sheets

(56) References Cited

U.S. PATENT DOCUMENTS

| | | | | | |
|---|---|---|---|---|---|
| 3,207,347 | A | | 9/1965 | Ehrlich | |
| 3,229,830 | A | | 1/1966 | Smith | |
| 3,396,862 | A | | 8/1968 | Fischer | |
| 3,410,432 | A | | 11/1968 | Foss et al. | |
| 3,415,339 | A | | 12/1968 | Range | |
| 3,534,990 | A | | 10/1970 | Didtel et al. | |
| 3,587,893 | A | * | 6/1971 | Laken | B66F 9/061 414/563 |
| 3,674,161 | A | | 7/1972 | Grinde | |
| 3,734,319 | A | | 5/1973 | Frisk | |
| 3,759,399 | A | | 9/1973 | Glass et al. | |
| 3,788,492 | A | | 1/1974 | Kraft | |
| 3,851,777 | A | | 12/1974 | Dilny | |
| 4,065,013 | A | | 12/1977 | Orthman | |
| 4,102,464 | A | | 7/1978 | Schuster | |
| 4,230,434 | A | | 10/1980 | Seaberg | |
| 4,426,188 | A | | 1/1984 | Wolf et al. | |
| 4,488,832 | A | | 12/1984 | Kinshofer | |
| 4,568,217 | A | | 2/1986 | Forsman et al. | |
| 4,579,504 | A | * | 4/1986 | Lemme | B66F 9/061 212/201 |
| 4,699,565 | A | | 10/1987 | Seaberg | |
| 4,850,789 | A | * | 7/1989 | Zimmerman | B66F 9/061 172/272 |
| 5,033,934 | A | | 7/1991 | Emilio | |
| 5,145,034 | A | | 9/1992 | Miles | |
| 5,244,336 | A | | 9/1993 | Engler et al. | |
| 5,975,831 | A | | 11/1999 | Martin | |
| 6,233,827 | B1 | | 5/2001 | Oliver et al. | |
| 8,568,078 | B2 | * | 10/2013 | Ornig | B61D 19/001 414/607 |
| 2004/0197178 | A1 | | 10/2004 | Osterloh et al. | |
| 2004/0208734 | A1 | * | 10/2004 | Shoemyer | B66F 9/18 414/607 |
| 2007/0183882 | A1 | | 8/2007 | Salazar | |
| 2008/0101907 | A1 | | 5/2008 | Hedstrom et al. | |
| 2011/0226556 | A1 | * | 9/2011 | Balcom | B66F 9/12 187/237 |
| 2013/0284541 | A1 | * | 10/2013 | Balcom | B66F 9/12 187/237 |

* cited by examiner

FORK TRUCK BOOM APPARATUS

CROSS-REFERENCE TO RELATED APPLICATION

This application claims benefit under 35 USC §119(e) of U.S. Provisional Application Ser. No. 61/778,734, filed Mar. 13, 2013, entitled FORK TRUCK BOOM APPARATUS the entire contents of which are incorporated herein by reference.

BACKGROUND OF THE INVENTION

The present invention relates to a detachable boom for fork trucks that is releasably attachable in different ways to a fork truck, but further that is safely retained thereto without dependence on a safety chain.

Some existing boom accessories for fork trucks include a frame adapted to engage the forks of a fork truck, and a boom extending from the frame. When lifted, the forks lift the frame and in turn lift the boom and any object hanging on an end of the boom. Sometimes during use due to an incline of the forks or of the fork truck itself, the forks will be angled slightly downward, such that the boom accessory (and any object carried thereon) will tend to slide forward off the end of the forks (tines). Some boom accessories use a safety chain hooked between the accessory frame and the fork truck's carriage to prevent the accessory frame from accidentally sliding forward off the tines. However, safety chains have been known to be accidentally shaken off or disengaged (or are not properly installed), resulting in a potential risk where the boom accessory and the carried object accidentally come off. This can result in damage to the object being moved and, in some circumstances, cause a safety hazard. A more positive retention mechanism is desired that is less sensitive to operator error and less sensitive to being shaken loose or accidentally dislodged.

Another concern is flexibility of attachment of a boom accessory to fork trucks. Fork trucks and related accessories (such as boom apparatus) require large capital investment, and this investment is inefficiently used when the accessory only fits one fork truck (or only fits one type of fork truck). Thus, companies often take steps to minimize capital expenditure, such as by purchasing a single fork truck with multiple accessories, or by purchasing a flexible accessory that can be used on multiple different fork trucks and/or a combination of those arrangements. However, fork trucks have different carriage and fork tine support structures, such that accessories (such as boom accessories) do not fit on all different fork trucks.

SUMMARY OF THE INVENTION

In one aspect of the present invention, a boom accessory is provided for a fork truck that includes a carriage and lifting forks. The boom accessory includes a boom frame having receiver tubes adapted to receive the lifting forks for lifting the boom frame, and a boom attached to the boom frame and extending forwardly. The accessory further includes a convertiplate removably vertically attached to the boom frame and includes carriage-attaching top and bottom connectors for securely engaging mating structure on the fork truck's carriage. An anchor assembly includes an anchor connected between the convertiplate and the boom frame to restrain the boom frame falling forwardly, but the anchor permits vertical movement so that a weight of the boom frame, the boom, and a boom-carried load is carried by the connectors and the carriage. The anchor characteristically does not include a cable or chain.

In another aspect of the present invention, a boom accessory includes a boom frame having an elongated boom extending from a front side and having first top and bottom hook connectors extending from a rear side for engaging tine-supporting structure on the carriage to lift the boom frame a first way and still further having fork-tine-receiving tubes on a bottom side for receiving the lifting forks to lift the boom frame a second way. A frame-to-carriage anchor assembly is removably attached to the boom frame for anchoring the boom frame on the carriage when the fork-tine-receiving tubes are used to lift the boom frame, but is removable to avoid interfering with attachment of the first and second hook connectors to the tine-supporting structure.

In another aspect of the present invention, a method is provided for mounting a boom accessory to a fork truck having a carriage and lifting forks. The method includes providing a boom frame having a boom extending forwardly and also having a back stiffener and also having receiver tubes for receiving the forks, attaching a removable convertiplate in juxtaposition to the back stiffener plate, and attaching an anchor between the convertiplate and the carriage, the anchor restraining the frame horizontally from falling forward but permitting vertical movement so that a weight of the frame, boom, and boom-carried load.

These and other aspects, objects, and features of the present invention will be understood and appreciated by those skilled in the art upon studying the following specification, claims, and appended drawings.

DETAILED DESCRIPTION

Figure 3:
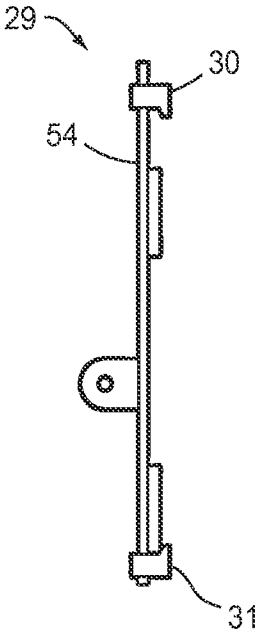
FIGS. 2-3 are side views of the anchoring brackets for engaging mating structure on the fork truck's carriage, FIG. 2 showing the cross bars of the carriage abutting the boom accessory but with the top hook connector not yet attached, and FIG. 3 showing the anchor attached to the cross bars of the carriage using the top hook connector.

The present apparatus (FIGS. 1-3) includes a boom accessory 20 for releasable attachment to a fork truck 21, where the fork truck 21 includes a carriage 22 with fork-carrying transverse cross bars and laterally-spaced-apart lifting forks 23. The boom accessory 20 includes a boom frame 25 having a pair of receiver tubes 26 for receiving the forks 23, a boom 27 attached to the frame 25 and extending forwardly, and a frame-to-carriage anchor assembly 28 on the frame 25. The frame-to-carriage anchor assembly 28 includes a carriage-attaching subassembly 29 with top and bottom hook-shaped connectors 30 and 31 for securely engaging mating structure 32 and 33 (shown as cross bars) on the fork truck's carriage 22, the top connector 30 being downwardly adjustable (or the bottom connector 31 being upwardly adjustable) to positively engage the cross bars on the carriage 22.

An anchor 34 (also called a "vertical receiver") (FIGS. 1A-1B) is located between the carriage-attaching subassembly 29 and the frame 25 to restrain the frame 25 from horizontally sliding off the forks 23, while still permitting (i.e. not interfering with) vertical lifting movement of the boom by the fork truck. Specifically, the frame 25 includes a plate-shaped back stiffener 25A that provides a good-width support surface for the connectors 30 and 31. The anchor 34 bolts to the back stiffener 25A and includes vertical plates 36 defining a vertical guide 37 formed by aligned vertical slots, and a guide follower 38 engaging the vertical guide slot 37. Notably, the anchor 34 can be used when the connectors 30 and 31 are engaging the fork truck's carriage's cross bars, or can be used when the forks 23 are being used to lift the boom accessory 20. By this arrangement, the forks 23 can lift a weight of the boom accessory 20 (including the frame 25, boom 27, and any boom-carried load) without stressing the anchor assembly 28, but with the anchor assembly 28 preventing the boom accessory (including the frame 25 and boom 27) from sliding forward off the forks 23.

Figure 4:
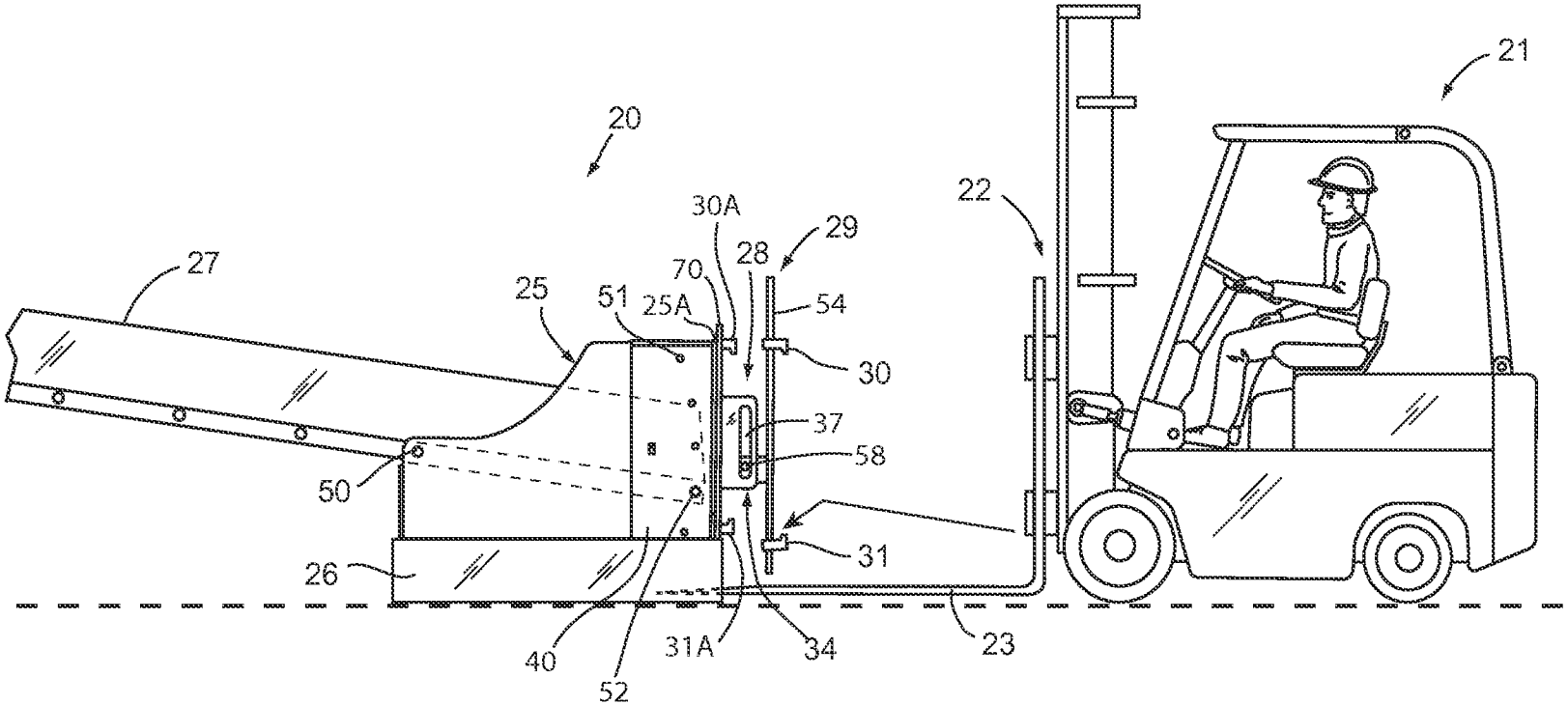
FIG. 4 is a side view of a fork truck ready to engage the boom accessory but with the boom accessory including a convertiplate.

More specifically, the boom frame 25 (FIG. 1B) includes two receiver tubes 26 mounted under a boom-carrying box subframe 40. The box subframe 40 includes various plates and gussets welded together to form a rigid framework/bridge between the tubes 26. The boom frame 23 includes the back stiffener plate 25A, and also includes a pair of upright plates 41 forming a space for the tail end of the boom 27. The illustrated boom 27 includes a primary boom beam 43, and a telescopingly extendable boom beam 44 with an end attachment bracket 45 for supporting a hook or lift cable. The illustrated bracket 45 includes a protrusion with aperture 46 for receiving a bolt or other attachment, such as a boom hook carrying an object to be lifted. Also, a bottom flange 47 along the boom 43 provides additional attachment sites/apertures for carrying loads on the boom 27. The tail section of the boom 27 (FIGS. 1B and 4) (which is similar in shape and structure to illustrated sections of the boom 27) extends to a rear area between upright plates 41. The upright plates 41 define a boom pivot 50 and further include a series of boom-angle-fixing anchoring holes 51 spaced rearwardly and arcuately around the boom pivot 50. The boom 27 is pivoted on a pivot pin extended through the boom pivot 50, and is anchored in a selected angular position by an angle-fixing lock pin 52 extended through a selected one of the anchoring holes 51.

The frame-to-carriage anchor assembly 28 (FIGS. 2-3) includes a carriage-attaching subassembly 29 having a vertical plate post 54. The illustrated bottom hook connector 31 is fixed on a bottom of the post 54 (such as by being bolted) and faces upwardly so that it is oriented to engage the bottom portion of the mating structure 32 and 33 (i.e. cross bars) on the fork truck's carriage 22. In the illustrated arrangement, the top hook connector 30 is also fixed on the post 54. Alternatively, it is contemplated that the top hook connector (or bottom hook connector) could be vertically adjustable and fixed in its adjusted vertical position on post 54 by use of a shear pin or bolt. The illustrated bottom hook connector 31 is bolted in place. For example, during attachment, a fork truck can be moved into position with its carriage frame engaging the top hook connector 30. The bottom hook connector 31 then would be bolted in place while engaging the lower cross bar of the carriage, thus capturing the carriage-attaching assembly 29 on the fork truck. Alternatively, the bottom connector 31 can be engaged first, and the top connector 30 attached to fixed connection.

As noted above, the anchor 34 (FIG. 4A) includes two spaced-apart vertical plates 36 on the frame 25 each with the vertical guide 37 (formed by a vertical slot), and a guide follower 38 with a transverse pin 58 slidably engaging the vertical guide slot 37. It is contemplated that instead of two vertical plates 36, there may be only a single vertical plate (36), and in such case the guide follower 38 would include a pair of spaced-apart tabs supporting a transverse pin and straddling the single vertical plate 36.

Figure 1:
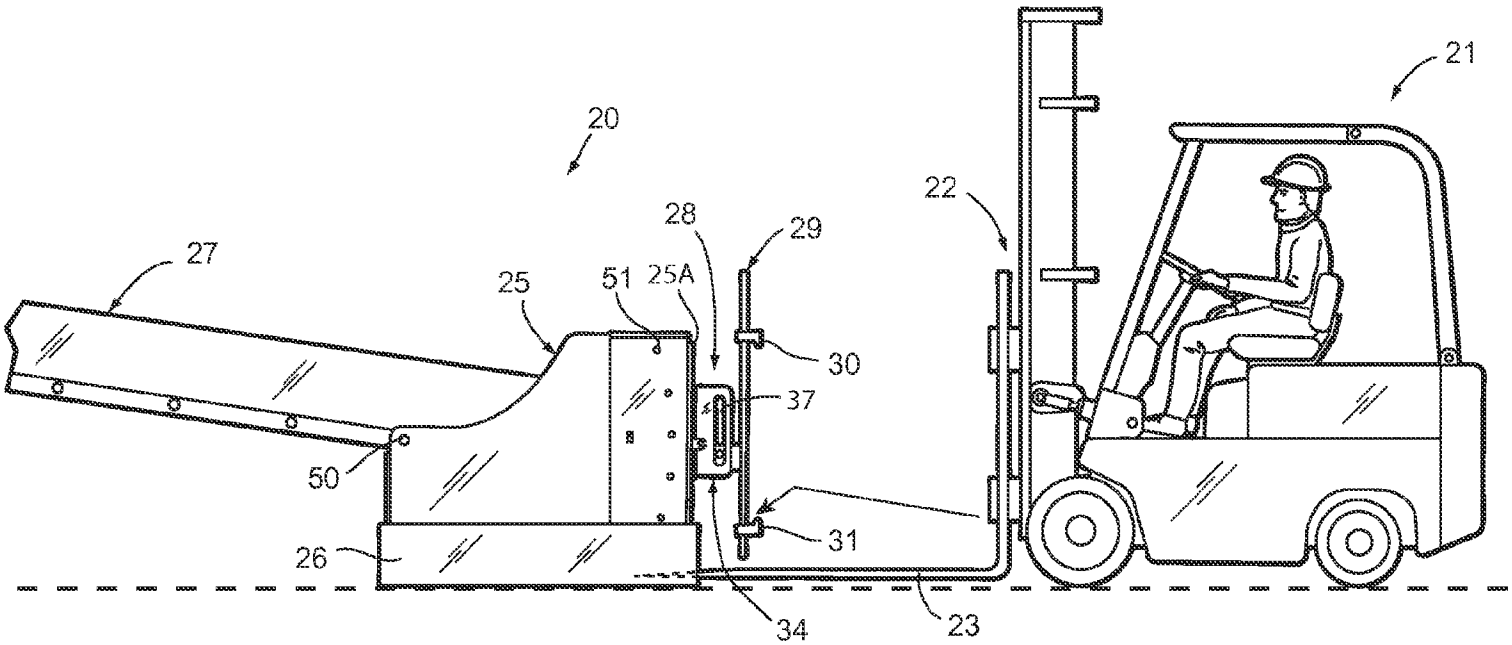
FIG. 1 is a side view of a fork truck ready to engage a boom accessory.
Figure 2:
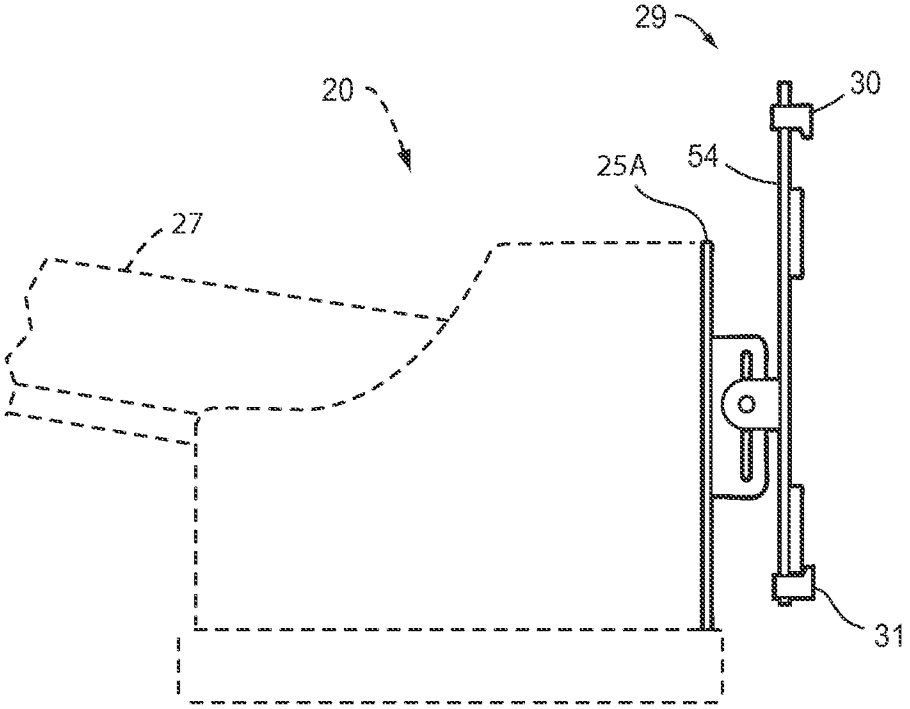

As illustrated in FIGS. 1-2, the anchor 34 is bolted to the back stiffener 25A. When the fork truck's carriage is connected directly to the connectors 30 and 31 with the anchor assembly 28 also connected, the arrangement allows the anchor 34 to provide a significant holding force to be transmitted from the mating structure on the carriage 22 through the connectors 30, 31 and the post 54, through the guide 37 and guide follower 38, to the boom-supporting box subframe 40. This arrangement is very secure, and hence is very unlikely to accidentally or unexpectedly release. By this arrangement, the forks 23 can lift a weight of the boom accessory 20 (including the frame 25, boom 27, and any boom-carried load) without undesirably stressing the anchor assembly 28, and with the anchor assembly 28 preventing the boom accessory (including the frame 25 and boom 27) from undesirably being released.

Figure 4A:
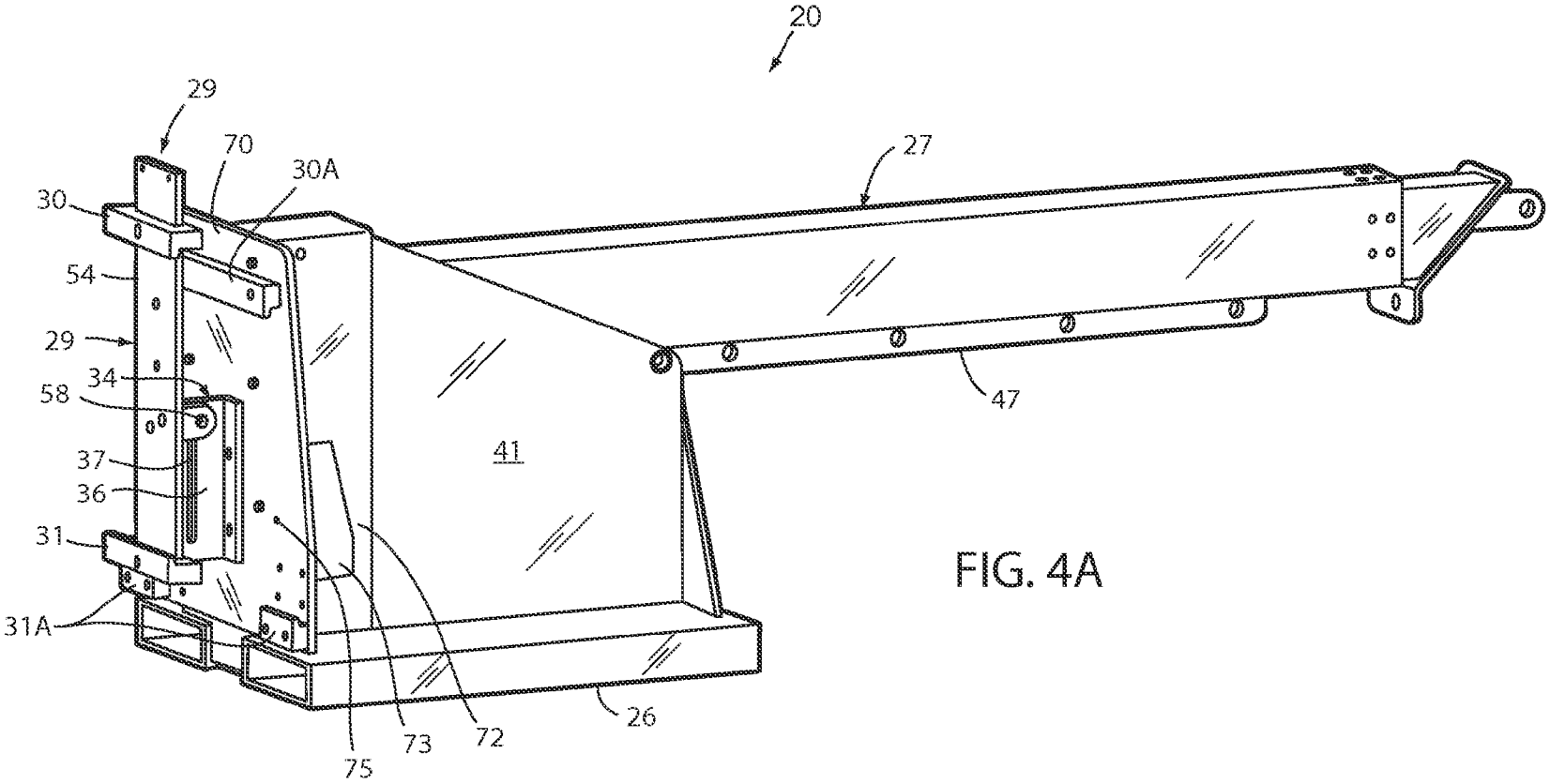
FIGS. 4A and 4B are perspective views of the boom accessory in FIG. 4.
Figure 4B:
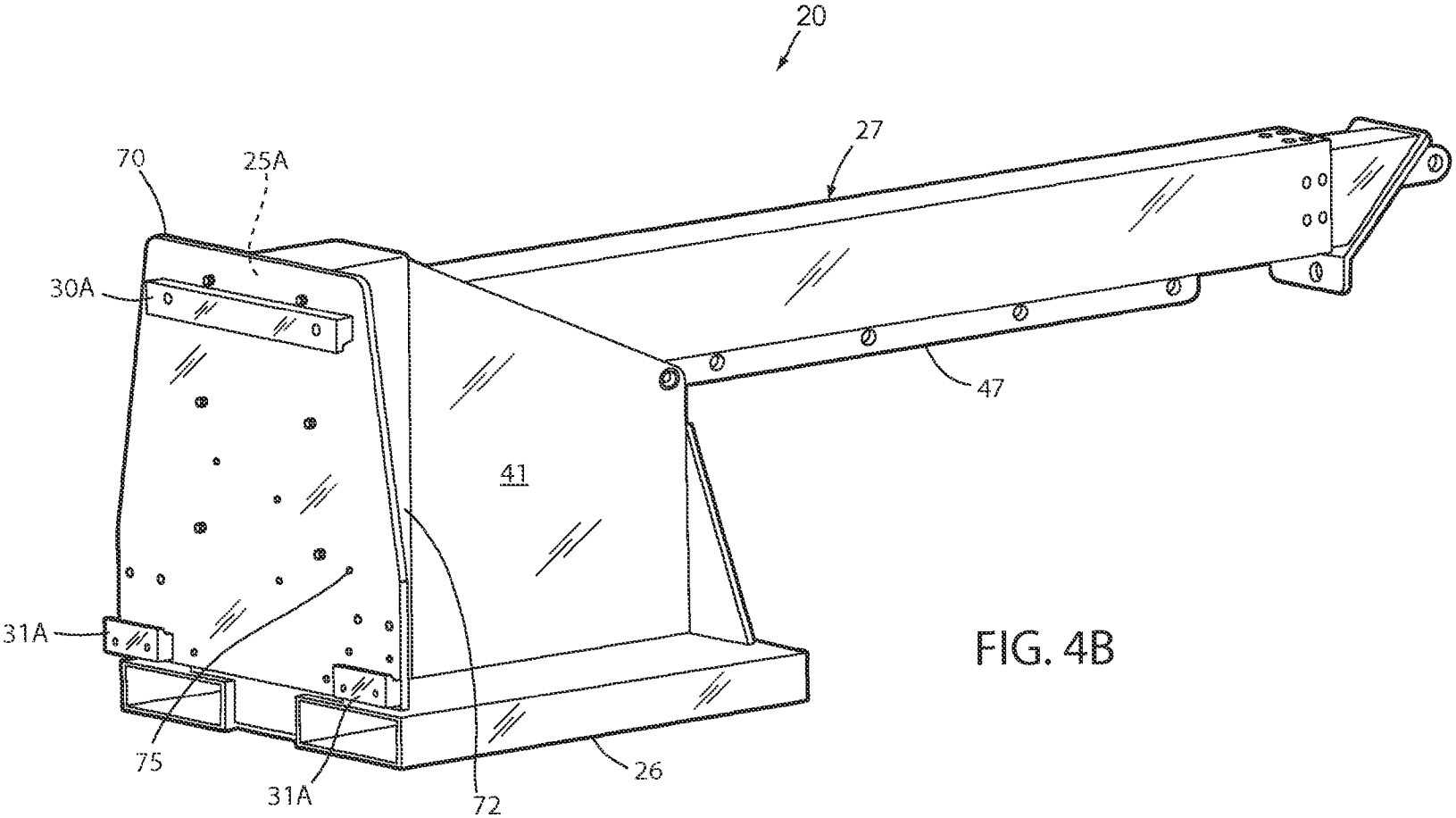
Figure 6:
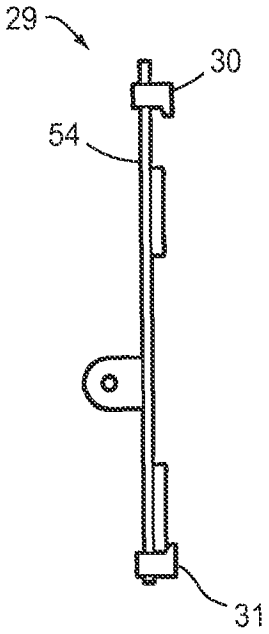
FIGS. 5-6 are side views of the anchoring brackets for engaging mating structure on the fork truck's carriage, FIG. 5 showing the carriage abutting the anchor but not yet attached, and FIG. 6 showing the anchor attached to the carriage.
Figure 5:
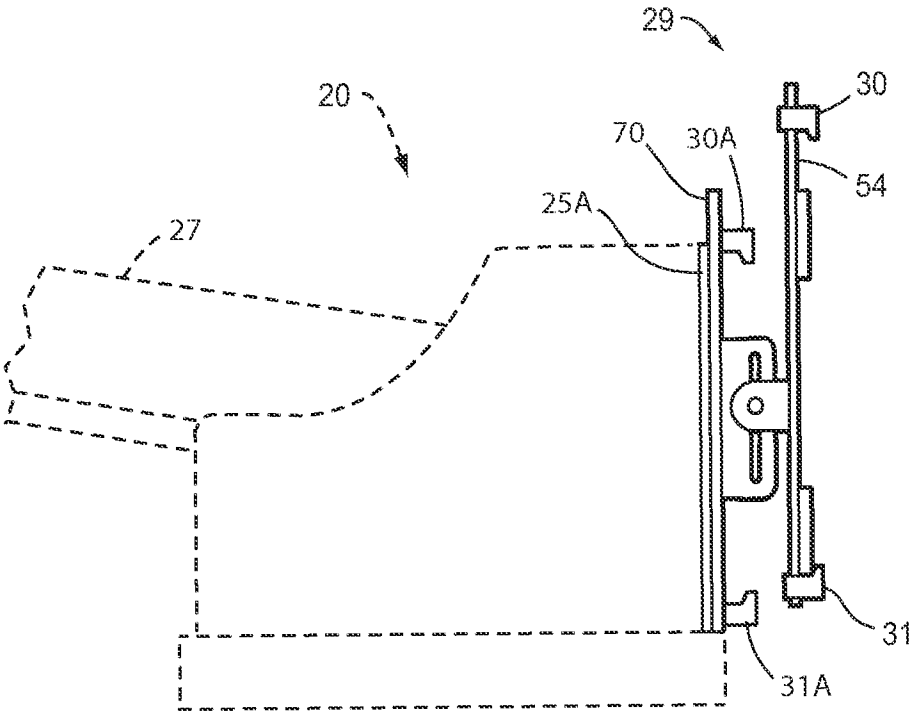

In FIGS. 4A, 5-6, a convertiplate 70 is bolted/mechanically attached to the back stiffener plate 25A, and the anchor 34 is bolted to the convertiplate 70, which is attached to the back stiffener 25A. Notably, the convertiplate 70 is wider than the stiffener plate 25A, thus providing lateral stability and also providing an increased potential range of adjustable positioning of one or more of the connectors 30 and 31, and/or of adjustably positioning the anchor assembly 28. One of the benefits is that the convertiplate 70 allows the connectors 30 and 31 and/or the anchor assembly 28 to be positioned in a non-interfering position with the fork truck's carriage and cross bars and other carriage's structure. The illustrated bottom connector 31 is adjustable vertically between different height positions, but it is contemplated that the convertiplate 70 can be constructed so that the connector 31 (or 30) could be either vertically and/or horizontally adjustable. This arrangement can then be used to connect directly to the cross bars on a fork truck's carriage, similar to the arrangement described above in FIGS. 1-3. The increased width of the illustrated convertiplate 70 is illustrated in FIGS. 4A and 4B, which show the upper connector 30A as itself being wider and the two lower hook connectors 31A as being spaced apart. In addition to increased width positions, this arrangement provides an advantage, such as by providing clearance to the fork truck's carriage, which is sometimes needed. FIG. 4A shows that the anchor 34 can be unbolted from the convertiplate 70 (see FIG. 4B), so that top and bottom hook connectors 30A and 31A on the convertiplate 70 can be directly engage the fork supporting carriage structure 22 on the fork truck 21 without the need for an anchor assembly 28.

A significant concern with a boom apparatus 20 having a removable anchor is that the anchor may be removed, and then lost or misplaced. Specifically, after the anchor is removed, the fork truck and boom apparatus are driven away to a job site and used. At the end of the job, all work tends to stop, and no one matches the removed anchor with the boom apparatus. Later, when it is desirable to reattach the anchor to the boom apparatus, the anchor can no longer be found (or at least it takes significant effort and employee time to find it). This problem is solved in the present boom accessory 20 by the convertiplate 70, which incorporates a storage pocket 72 (FIG. 4A) (formed on a side of the convertiplate 70) by a bracket plate 73 at an outboard location adjacent the back stiffener 25A. Since the convertiplate 70 is wider than the back stiffener 25A, it creates a natural protected storage pocket 72 on a fork-truck-remote side of the convertiplate 70. The illustrated convertiplate 70 includes apertures 75 located so that the anchor 34 can be bolted in place and carried with the boom apparatus 20 at all times, even when not in use. My experience is that this particular feature is very popular with skilled trade workers, since it eliminates a frustrating part of keeping track of parts and pieces in this flexibly-attached boom apparatus.

Figure 1A:
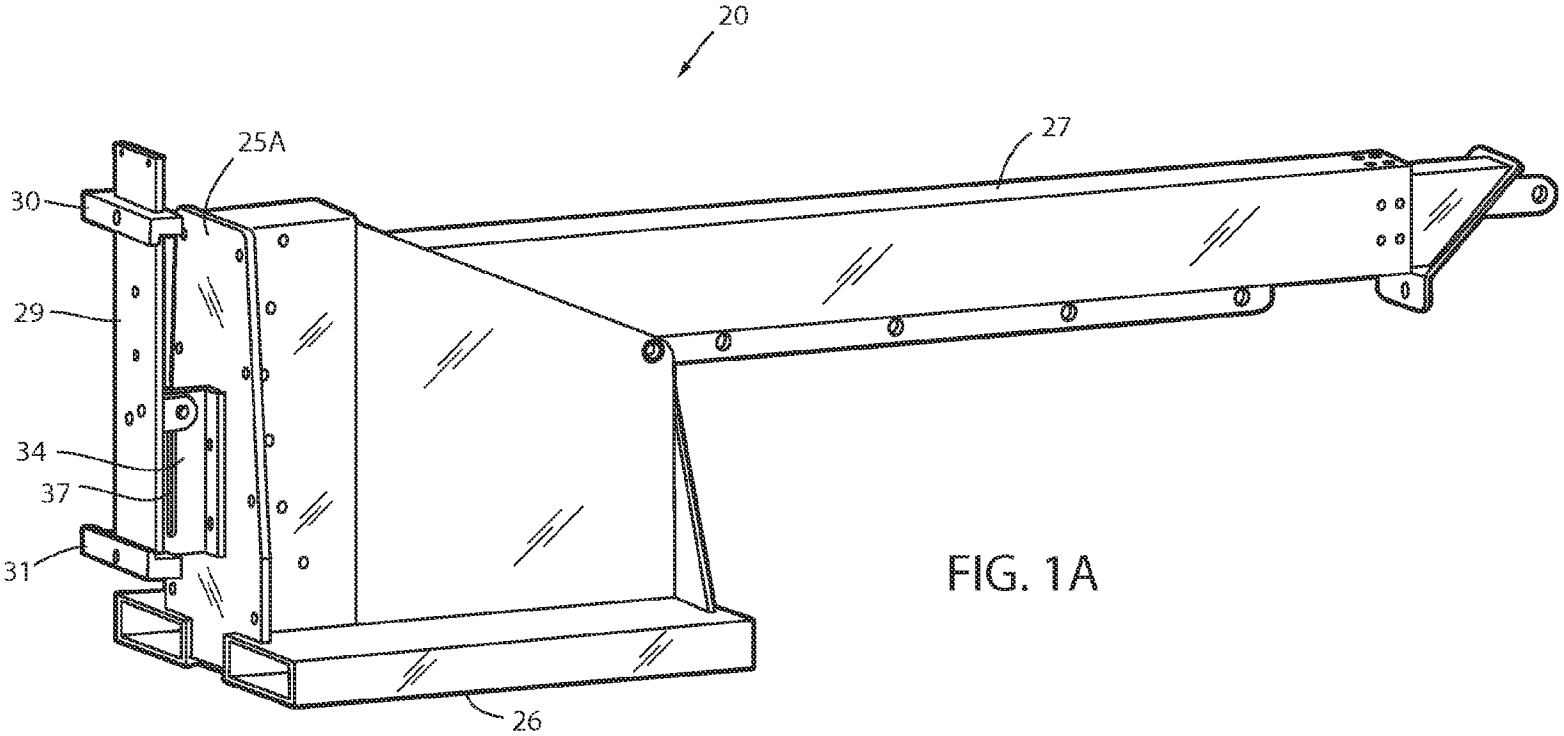
FIGS. 1A and 1B are perspective views of the boom accessory with and without the anchor shown in FIG. 1.
Figure 1B:
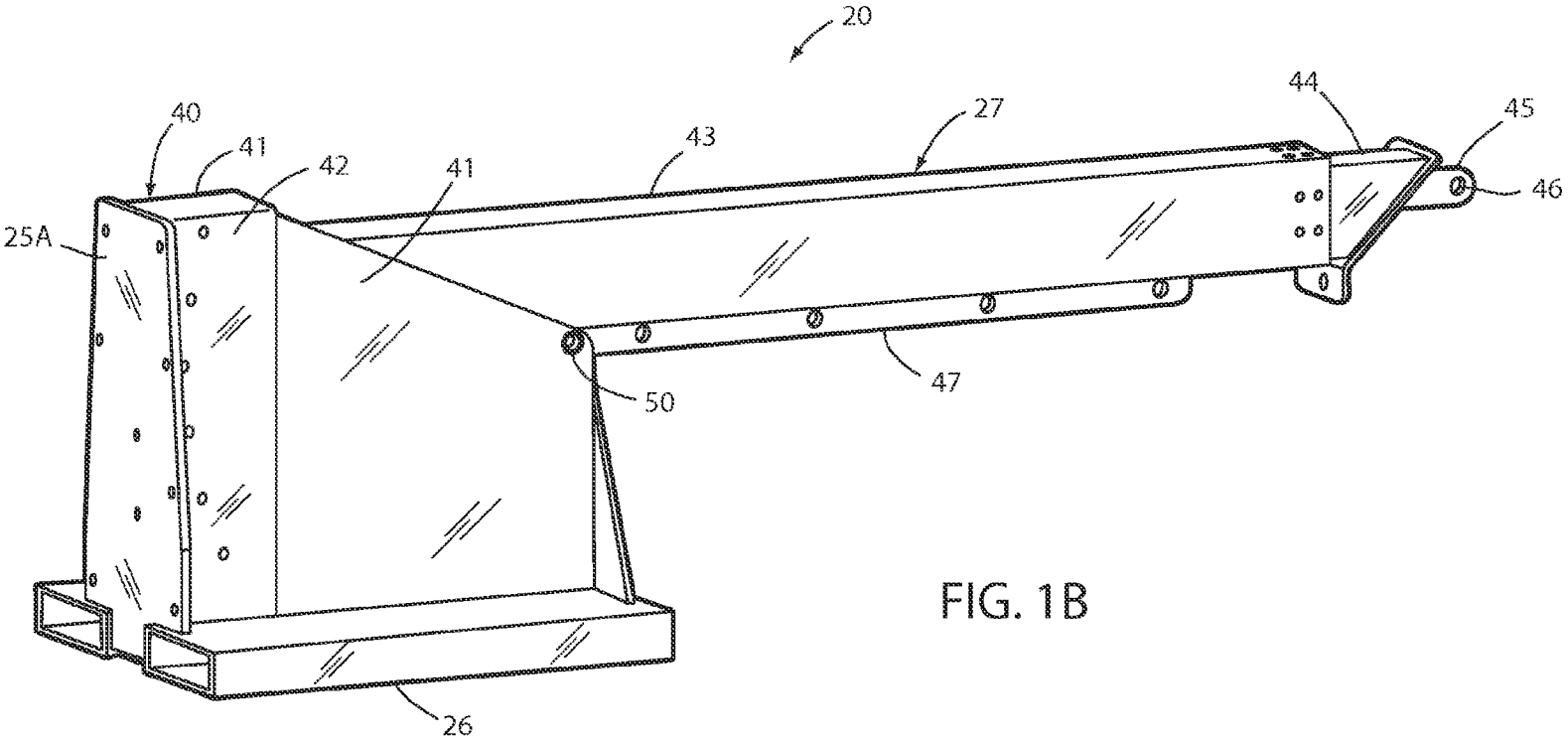

To summarize, the present boom apparatus 20 can be made to be like that shown in any of FIG. 1A, 4A, or 4B, thus providing three different attachment arrangements. The convertiplate 70 in particular can be very important as a manufacturer attempts to purchase a single boom attachment that is able to attach to various fork trucks.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A boom accessory for a fork truck including a carriage and lifting forks, comprising:

a boom frame having receiver tubes adapted to receive the lifting forks for lifting the boom frame;

a boom attached to the boom frame and extending forwardly;

a convertiplate attached to the boom frame and including carriage-attaching top and bottom connectors for securely engaging mating structure on the fork truck's carriage; and an anchor assembly with an anchor connected to the convertiplate that restrains the boom frame from falling forwardly, but that permits vertical movement so that a weight of the boom frame, the boom, and a boom-carried load is carried by the top and bottom connectors and the carriage, the anchor including at least one plate.

2. The accessory of claim 1, wherein the convertiplate spaces the anchor away from the boom frame.

3. The accessory of claim 1, wherein the boom frame including a back stiffener plate, and the convertiplate is wider than the back stiffener plate.

4. The accessory of claim 1, wherein at least one of the top and bottom connectors is bolted to the convertiplate.

5. The accessory of claim 1, wherein the anchor including a first bracket defining a vertical track and a follower engaging the vertical track for unrestricted vertical movement but zero horizontal movement.

6. The accessory of claim 5, wherein the vertical track comprises a vertical slot.

7. The accessory of claim 1, wherein the top and bottom connectors form opposing hooks.

8. The accessory of claim 1, wherein the convertiplate includes attachment holes defining different height positions, and at least one of the top and bottom connectors is engageable with the holes at a selected one of different height positions.

9. The accessory of claim 1, wherein the convertiplate defines a storage pocket adjacent the boom frame, the storage pocket being configured to receive and hold the anchor when not in use.

10. A method of mounting a boom accessory to a fork truck having a carriage and lifting forks, comprising:

providing a boom frame having a boom extending forwardly and also having a back stiffener and also having receiver tubes for receiving the forks;

attaching a removable convertiplate in juxtaposition to the back stiffener; and attaching an anchor between the convertiplate and the carriage, the anchor restraining the frame horizontally from falling forward but permitting vertical movement.

11. The method defined in claim 10, including providing tubes on the boom frame configured to receive forks of the fork truck for lifting the boom frame, and including a step of lifting the boom frame and boom using the tubes while anchoring the boom accessory on the forks using the anchor.

12. The method defined in claim 10, including providing top and bottom connectors on the convertiplate that are configured to engage cross bars on the carriage so that the fork truck can lift the boom accessory, and including a step of lifting the boom frame and boom using the top and bottom connectors.

13. The method defined in claim 12, including a step of removing the anchor and storing the anchor in a pocket defined by the convertiplate adjacent the boom frame while performing the step of lifting the boom frame and boom using the top and bottom connectors.

14. The method defined in claim 10, wherein the carriage includes cross bars, and including opposing connectors adapted to engage the cross bars to carry the weight of the frame, boom, and boom-carried load.

* * * * *